US006657547B2

(12) United States Patent
Ching-Yao

(10) Patent No.: US 6,657,547 B2
(45) Date of Patent: Dec. 2, 2003

(54) SENSING AND WARNING SYSTEM FOR LADDER LOAD

(76) Inventor: Kuo Ching-Yao, 2F, No. 3, Alley 22, Lane 139, Chiu-Chiung Street, Lu-Chou City, Taipeo Hsien (TW)

( * ) Notice: Subject to any disclaimer, the term of this patent is extended or adjusted under 35 U.S.C. 154(b) by 91 days.

(21) Appl. No.: 09/940,443

(22) Filed: Aug. 29, 2001

(65) Prior Publication Data

US 2003/0020622 A1 Jan. 30, 2003

(30) Foreign Application Priority Data

Jul. 25, 2001 (TW) ..... 90212606 U

(51) Int. Cl.[7] ..... G08B 21/00
(52) U.S. Cl. ..... 340/666; 182/18; 182/27

(58) Field of Search ..... 340/666; 182/18, 182/27, 108, 163, 204

(56) References Cited

U.S. PATENT DOCUMENTS 3,696,372 A * 10/1972 Garrett et al. ..... 182/18
5,279,387 A * 1/1994 Swiderski et al. ..... 182/27
5,853,065 A * 12/1998 Hutson et al. ..... 182/18

* cited by examiner

*Primary Examiner*—John A. Tweel, Jr.
(74) *Attorney, Agent, or Firm*—Troxell Law Office PLLC

(57) ABSTRACT

Disclosed is a sensing and warning system for ladder load composed of sending means, a recording and calculation device, and an alarm for detecting, recording and evaluating the ladder load, and sending an alarm signal in case the ladder is suffering from an overload so as to warn the user a dangerous state which should be evaded.

7 Claims, 10 Drawing Sheets

SENSING AND WARNING SYSTEM FOR LADDER LOAD

BACKGROUND OF THE INVENTION

1. Field of the Invention

The present invention relates to a sensing and warning system for ladder load, and particularly to a sensing and warning system composing of sensing means, a recording and calculation device, and an alarm for detecting, recording and evaluating the ladder load, and sending an alarm signal in case the ladder load exceeds its maximum withstandable value.

2. Description of the Prior Art

A ladder, a foldable or an extension type, is widely used in domestic and professional construction work.

FIG. 1 is a drawing of a common foldable ladder. The ladder has at least two pairs of ladder legs 11, 12, each pair of legs 11 and 12 is provided with a pair of feet 111, 112 and 121, 122 respectively, and each of them wears a mat 15 for increasing friction with the ground so as to prevent accidental slipping. A platform 13 is hinged to the top ends of the legs 11, 12 and a pair of hasps 14 is provided each releasably secured to the opposite leg 11 or 12 such that the ladder is developed in a derrick figure when in use.

For ensuring the use's safety, both the manufacturer and the inspection authority are very careful in upgrading the construction material and design criteria and always reminding the user how to use a ladder securely without overloading. As a matter of fact, people occasionally hear of accidents arising from misuse of ladders such as overloading and ignoring safety rules. Relief measures for victims' rehabilitation often cause great trouble to the manufacturer, the employer and the insurance company.

In order to overcome the problems inherent to the conventional ladders described above, the present inventor has studied this matter for a long time and developed the present invention.

SUMMARY OF THE INVENTION

Accordingly, it is an object of the present invention to provide a sensing and warning system for ladder load to be installed in the ladder feet for detecting, recording and calculating the ladder load, and sending an alarm signal in case the ladder load is dangerous.

It is another object of the present invention to provide a sensing and warning system for ladder load whose recorded and calculated loading data can assist to identify the responsibility in case of the occurrence of accident.

It is one more object of the present invention to provide a sensing and warning system for ladder load that the sensing means can be equipped in the hasp between two ladder legs so as to promptly warn the user entrained on the ladder in a critical situation such as collapse of the ladder by slipping.

To achieve these and other objects described above, the sensing and warning system for ladder load according to the present invention is composed of sensing means, a recording and calculation device, and an alarm. The sensor means further includes a connecting member, a sensor and a base. The connecting member is formed in a block structure and is concealed and engaged to each ladder foot. A sensor is installed under the connecting member, the base is located beneath the sensor but can be enclosed by a foot mat. The sensor is connected to a CPU of the recording and calculation device whose output terminal is further connected to the alarm. With this structure, the sensing means detects the ladder load at any moment and sends the detected data to the recording and calculation device for evaluation. If the ladder load exceeds the predetermined maximum allowable value, the alarm delivers a warning signal to the user.

BRIEF DESCRIPTION OF THE DRAWINGS

For fuller understanding of the nature and objects of the invention, reference should be made to the following detailed description taken in conjunction with the accompanying drawings.

DETAILED DESCRIPTION OF THE PREFERRED EMBODIMENTS

Figure 1:
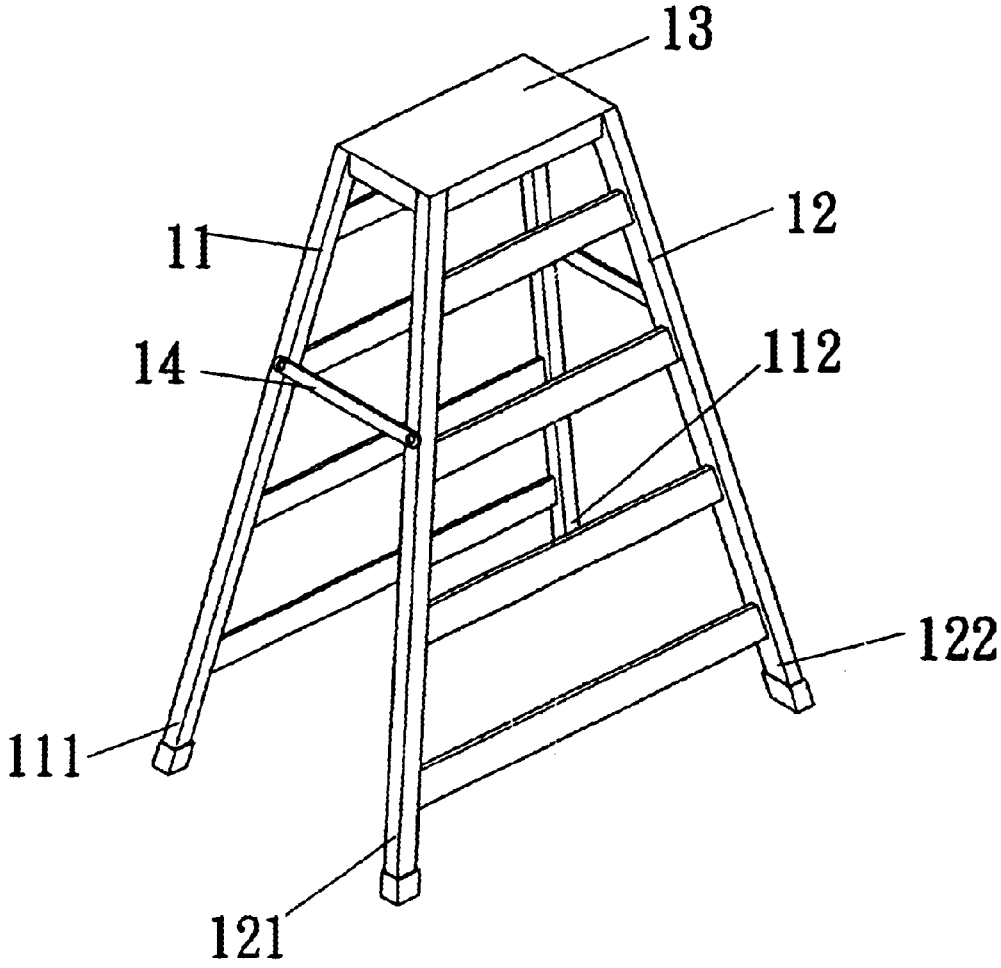
FIG. 1 (PRIOR ART)
FIG. 1 is a three dimensional view of a conventional ladder.
Figure 2:
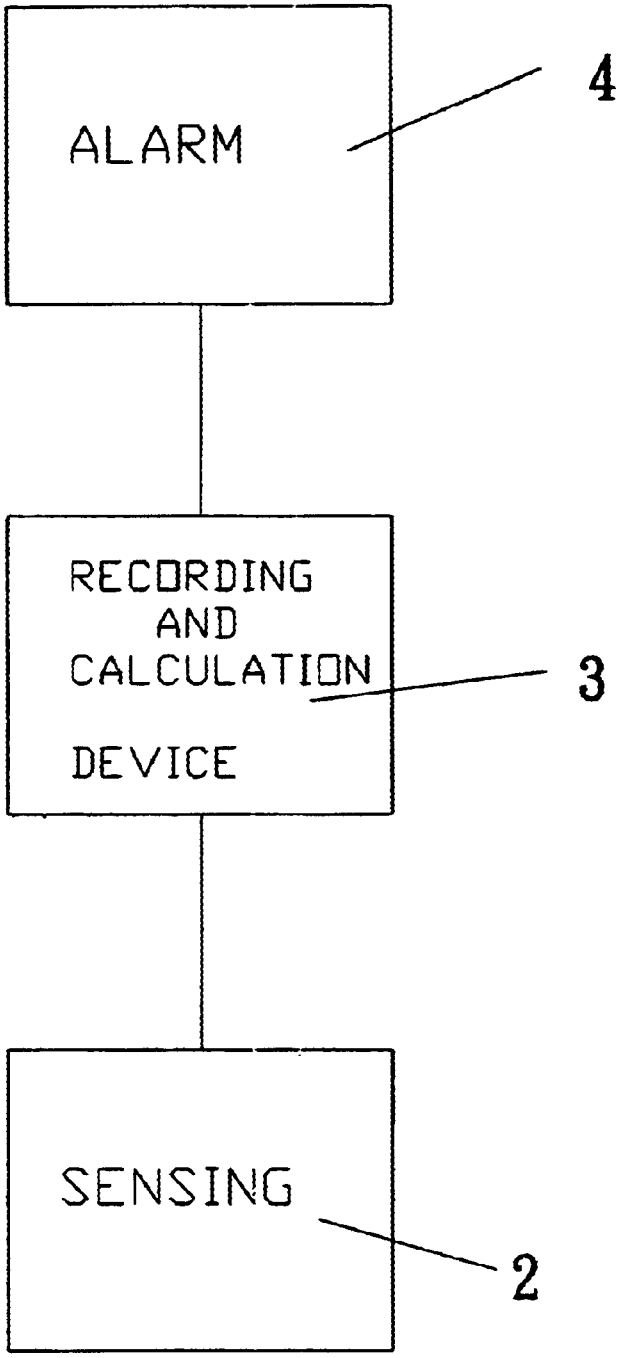
FIG. 2 is a block diagram of the present invention.

Referring to block diagram of FIG. 2, the sensing and warning system of the present invention is composed of sensing means 2, a recording and calculation device 3 (with a CPU), and an alarm 4.

Figure 3:
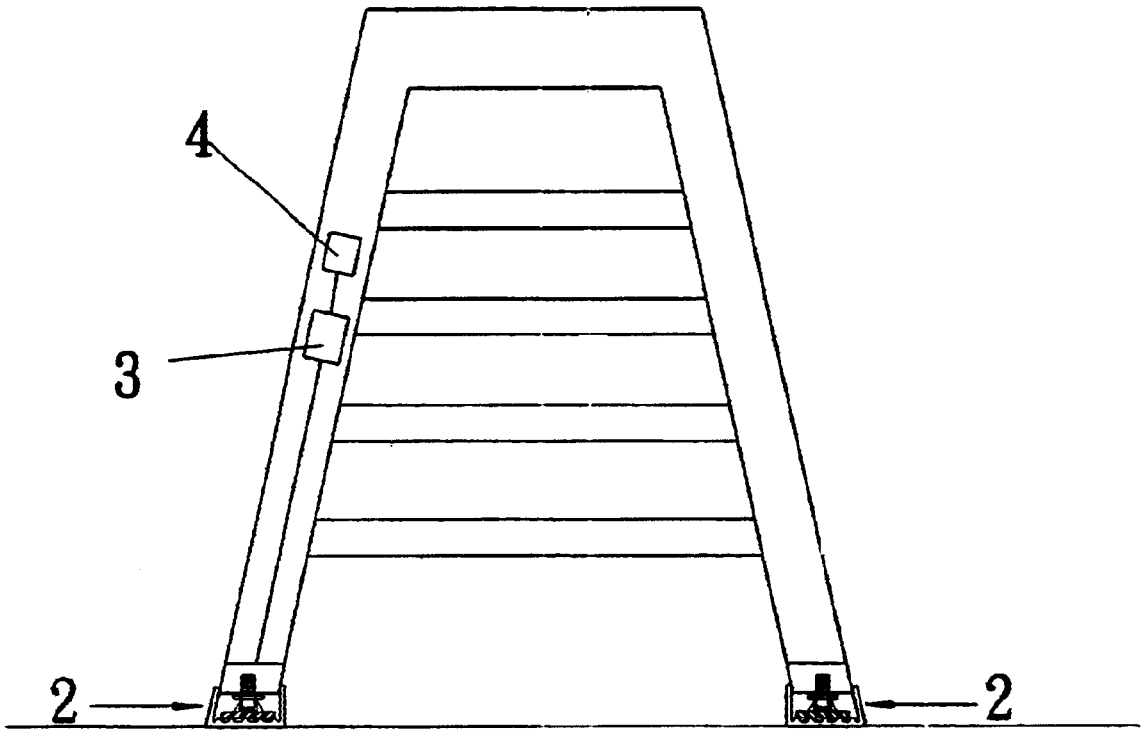
FIG. 3 is a cross sectional view showing the arrangement of the present invention.

Referring to FIG. 3, the sensing means 2 is equipped in each ladder foot, and the recording and calculation device 3, and the alarm 4 are equipped in each ladder leg above the sensing means 2.

Figure 4:
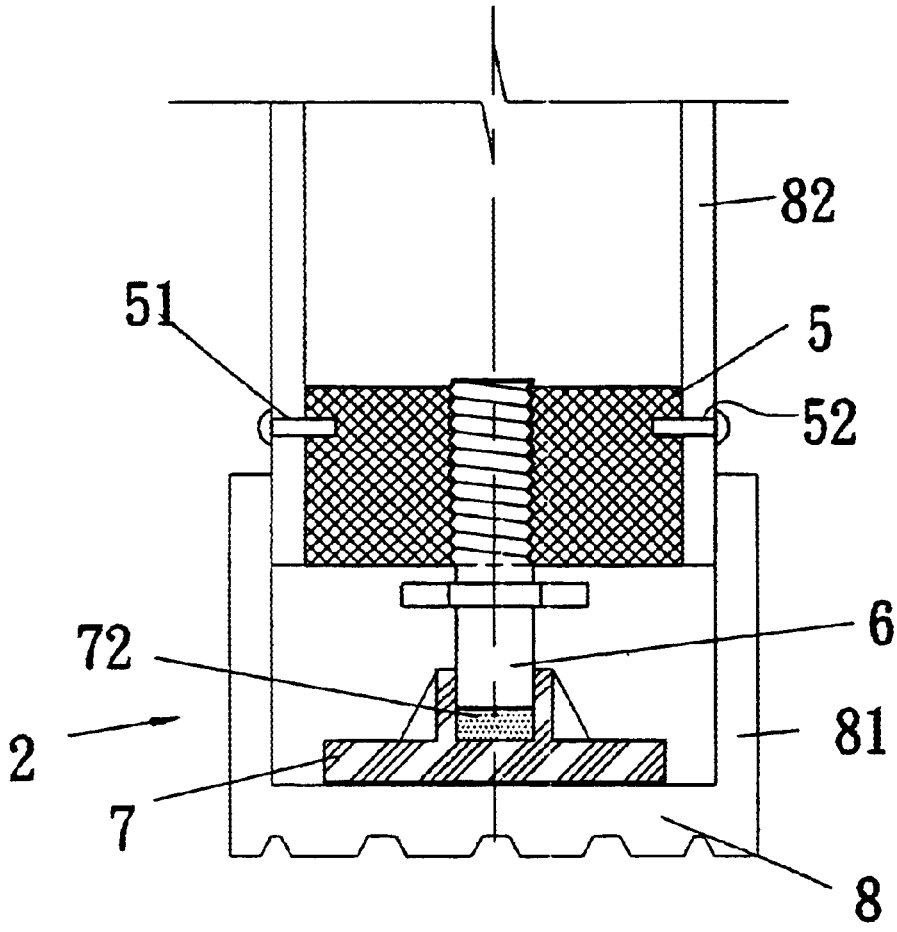
FIG. 4 is a partial cross sectional view illustrating the detail construction of the sensing means according to the present invention.
Figure 5:
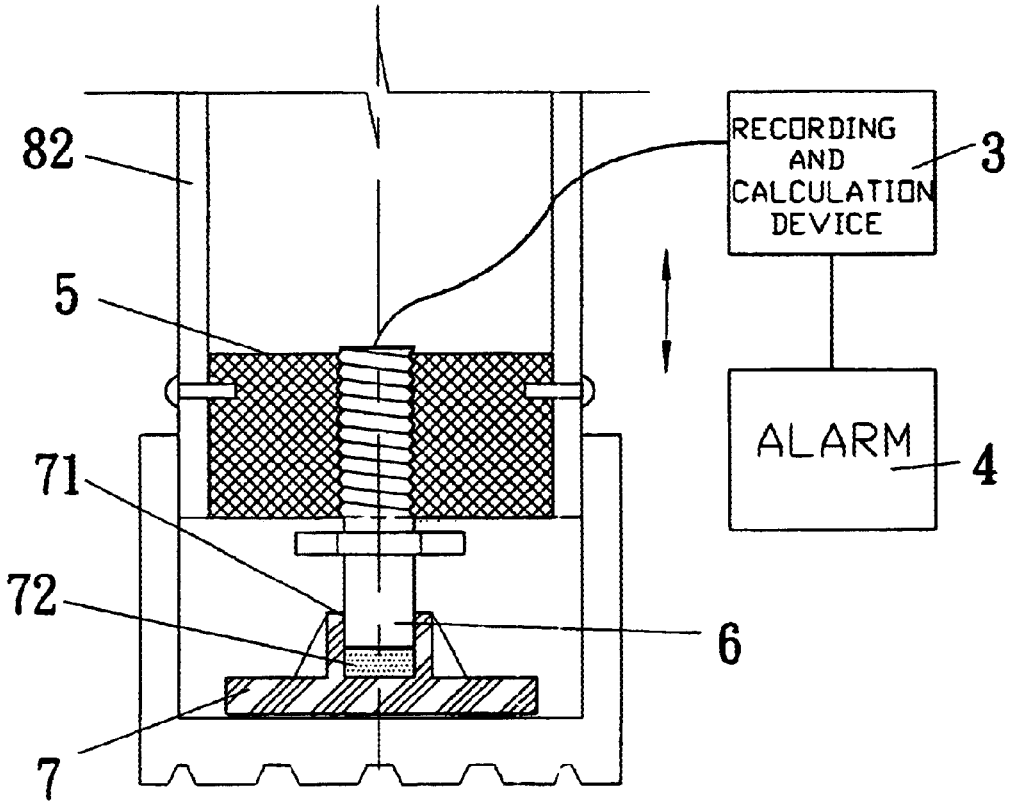
FIG. 5 is a cross sectional view illustrating the operation of the sensing means according to the present invention.

Referring to FIGS. 4 and 5, wherein the detail construction of the sensing means 2 is shown. The sensing means 2 includes a connecting member 5, a sensor 6, and a base 7. The connecting member 5 is formed in a block structure with a diameter corresponding to the inner diameter of a ladder foot 82 so as to be concealed in each ladder foot and screw combined to the ladder foot 82 through tapped holes 51, 52 at both sides thereof. Lower end of the sensor 6 is inserted into an oil container 71 formed at the center of the base 7 such that a liquid oil 72 filled in the oil container 71 is in contact with the probe of the sensor 6 thereby enabling the sensor 6 to detect a change of pressure and sending the detected data to the recording and calculation device 3.

Each base 7 wears a foot mat 8 which is snugly enclosing the ladder foot 82 with a collar 81 so that the ladder is able to vary its height as the loading of the ladder changes.

Referring to FIG. 5, when the ladders is in use, the sensing and warning system performs a monitoring function through built-in interconnection wiring. In case the ladder loading exceeds predetermined maximum allowable value of the system, the value is detected by the sensor 6 and sent to the CPU of the recording and calculation device 3 for evaluation, and the recording and calculation device 3 sends a warning signal to the alarm 4 indicate it to operate. The alarm 4 may be a buzzer, and electronic strobe light (flasher), or other equivalents.

Figure 6:
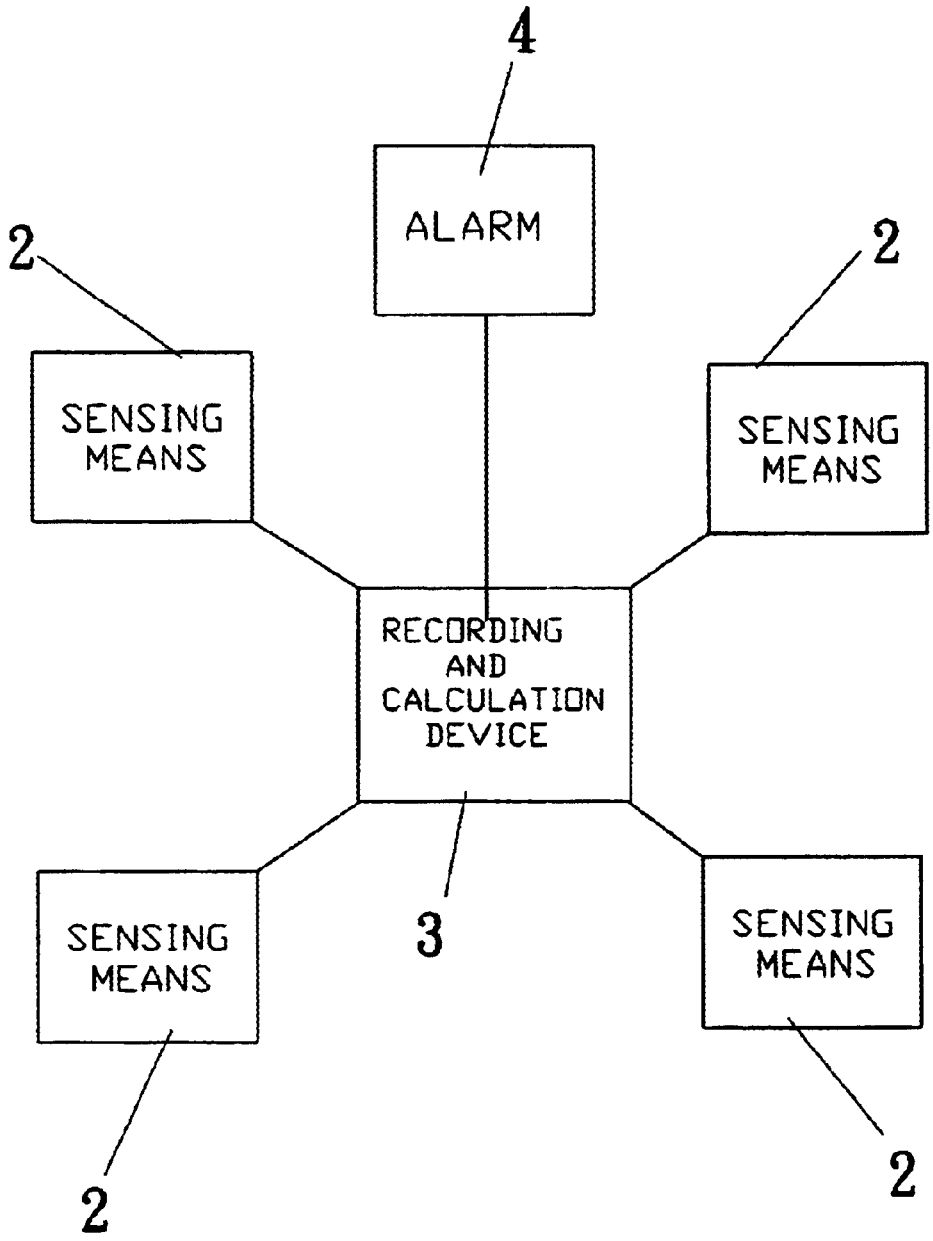
FIG. 6 is a block diagram in a first embodiment of the present invention.

Referring to FIG. 6, in a first embodiment of the present invention, the sensing means 4 is equipped in each four ladder feet. The circuit conductors are all connected to the recording and calculation device 3 to sum up individual loading on each ladder foot. As soon as the total value exceeds the predetermined maximum allowable value of the ladder load, the sound or light warning signal is delivered from the alarm 4.

Figure 7:
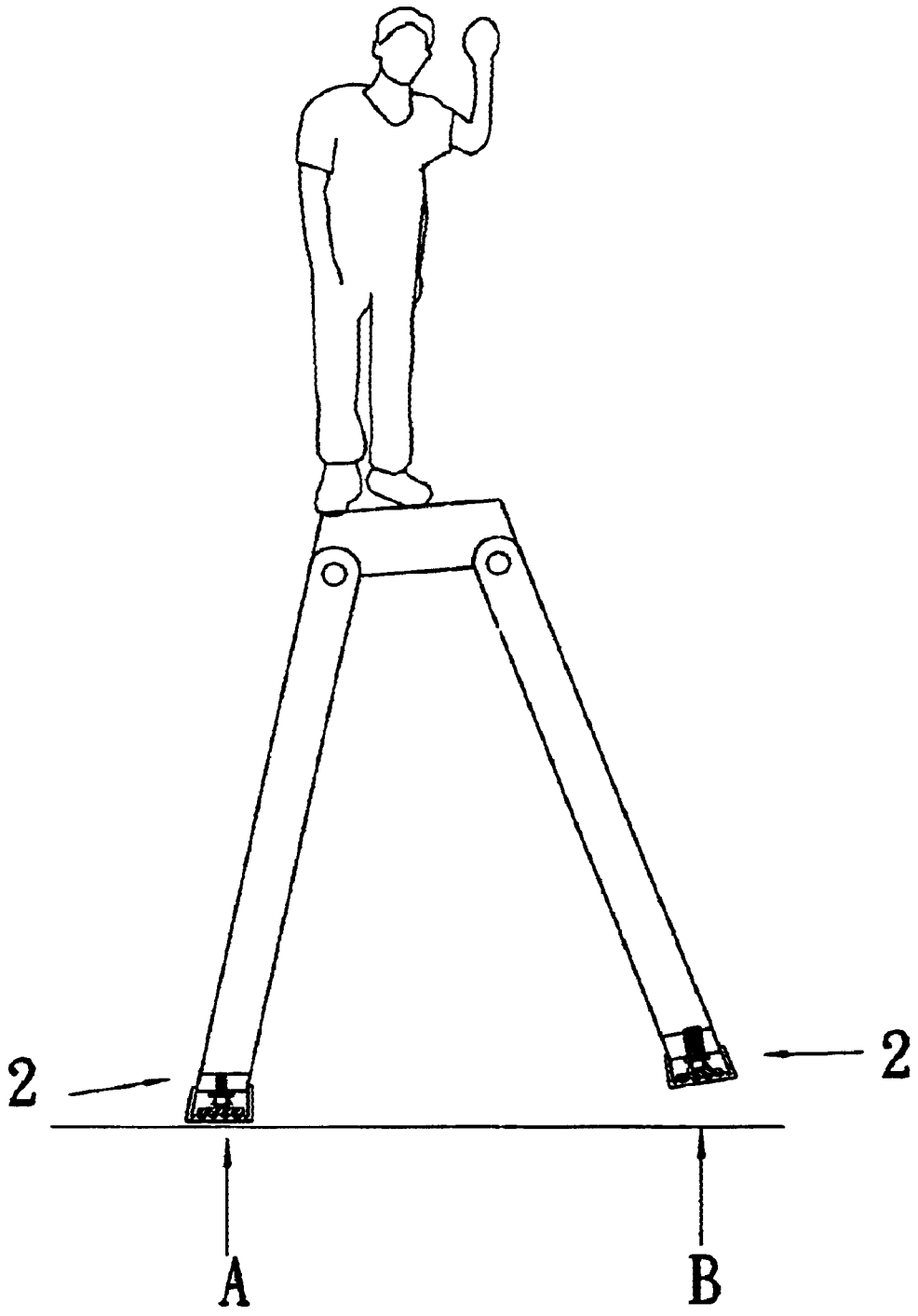
FIG. 7 is an exemporary view illustrating that the ladder is under an offset loading of the user's weight.

Referring to FIG. 7, in case the ladder is suffering from an offset loading, the ladder is likely to turn over (Pressure A>B) notwithstanding total load of the ladder has not yet exceeded its maximum allowable value. When a case occurs it can be evaluated by the recording and calculation device 4 for precaution and to help provide data for judging causes of accidents.

Figure 8:
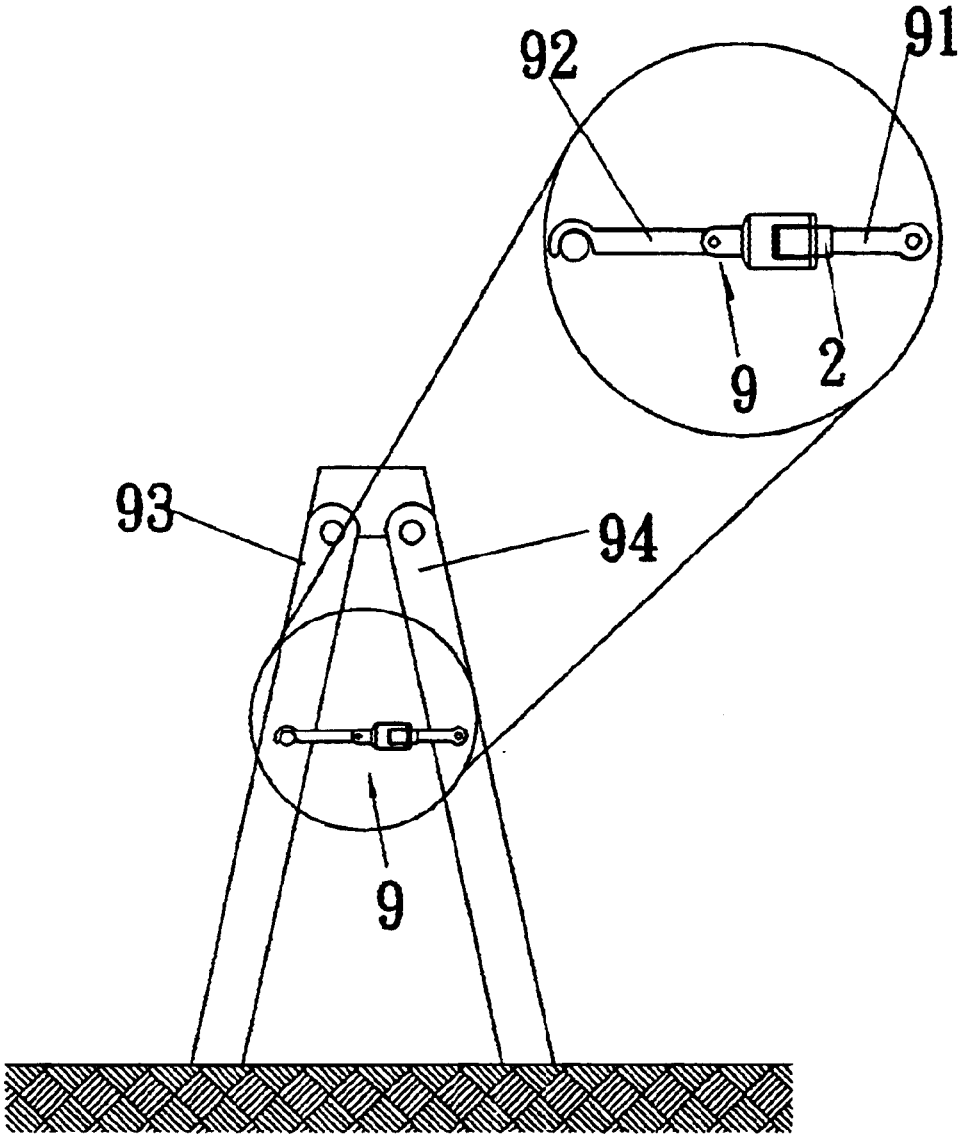
FIG. 8 is a view wherein the sensing means is equipped in a hasp connecting two ladder legs in a second embodiment of the present invention.

Referring to FIG. 8, in a second embodiment of the present invention, the sensing means 2 can be equipped in a hasp 9 jointing two ladder legs. One end of the sensing means 2 is engaged with the hinged end 91 of the hasp 9 while the other end thereof is engaged to the hooking end 92 of the hasp 9. By installing so the sensing means 2 is able to detect whether the tension exerting on the hasp 9 has exceeded the predetermined value or not.

Figure 9:
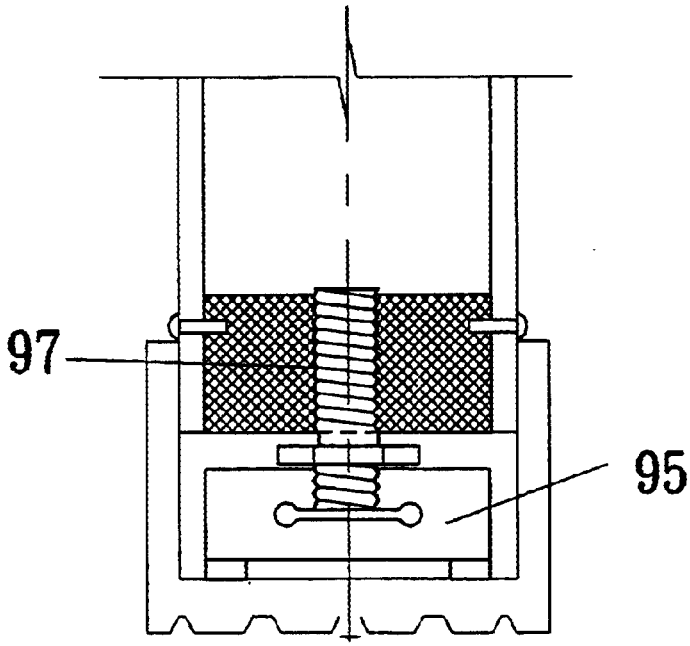
FIG. 9 is a view wherein a lever type sensor is employed by the sensing means in a third embodiment of the present invention.
Figure 10:
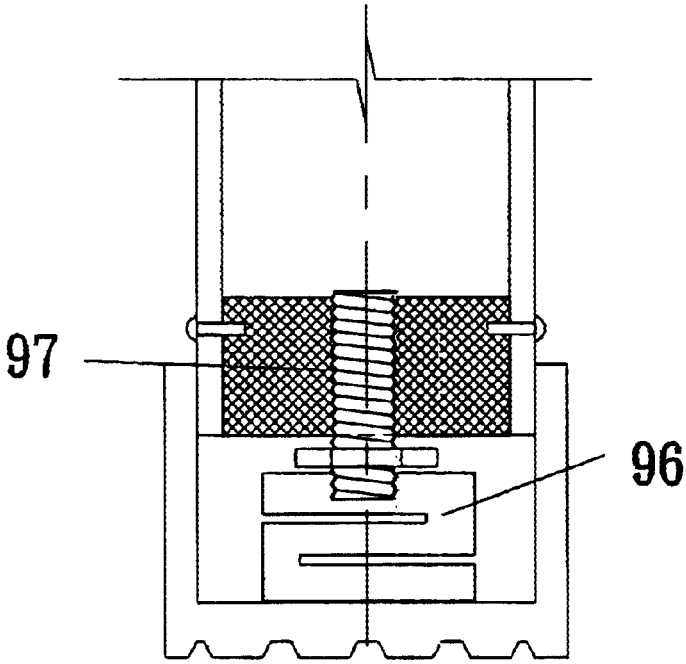
FIG. 10 is a view wherein a type sensor is employed by the sensing means in a fourth embodiment of the present invention.

The sensor 6 used in the sensing means 2 may be a lever type 95 in a third embodiment (FIG. 9), or an S type 96 in a fourth embodiment (FIG. 10). In the above two embodiments, only a connecting rod 97 is required to connect the sensor to the connecting member 5. As described above, the connecting member 5 may be formed into a block structure to be fitted into the ladder foot, or enclosed over the ladder foot, and then in the both cases, screw bolted with the ladder foot.

Figure 11:
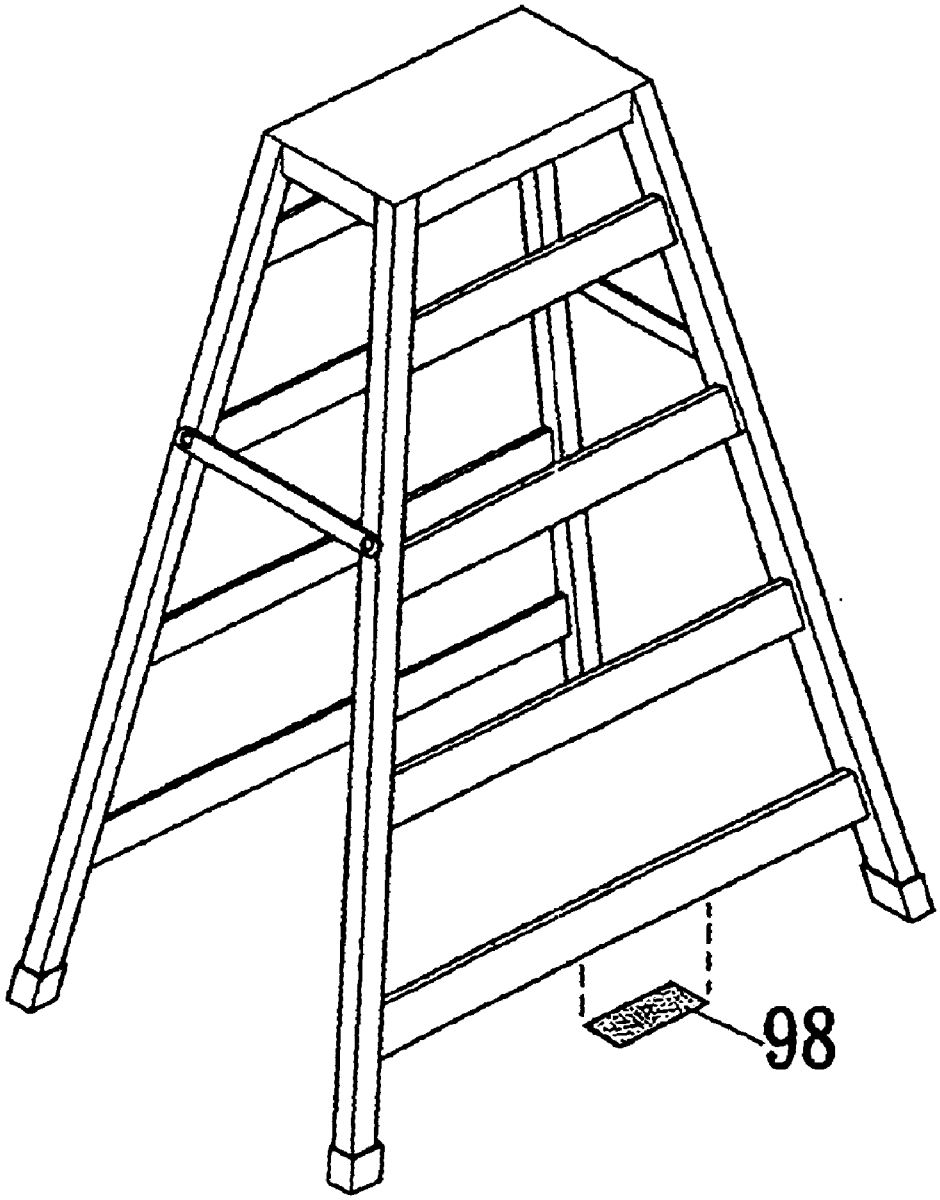
FIG. 11 is a view wherein a diaphragm sensor is employed by the sensing means in a fifth embodiment of the present invention.

Referring FIG. 11, wherein a diaphragm sensor 98 is used in a fifth embodiment, the diaphragm sensor 98 is directly attached to a ladder truss or other suitable place so as to detect the deformation of the truss.

It emerges from the description of the above several embodiments that the invention has several noteworthy advantages that the ladder provided with such a sensing and warning system can be used without worrying about the security of users so that the labor efficiency will be improved. Should there be an accident on the ladder equipped with the sensing and warning system of the present invention, it can provide reference data for judging the cause of accident and for precaution.

Those who are skilled in the art will readily perceive how to modify the invention. Therefore, the appended claims are to be constructed to cover all equivalent structures which fall within the true scope and spirit of the invention.

What is claimed is:

1. A sensing and warning system for ladder load comprising sensing means, a recording and calculation device, and an alarm, wherein said sensing means further includes a connecting member, a sensor and a base, wherein said connecting member is connected to a ladder foot, said sensor is installed beneath said connecting member, a lower end of said sensor is inserted in an oil container formed at a center portion of said base, said base is provided with a foot mat snugly enclosing over it;

said recording and calculation device includes a CPU for recording, calculating and evaluating a pressure signal imparted from said sensor;

said alarm is connected to said recording and calculation device for delivering a warning signal so as to remind the user the present loading condition of the ladder.

2. The sensing and warning system as claimed in claim 1, wherein said foot mat is snugly enclosing said base and the ladder foot but is not fixedly adhered thereto.

3. The sensing and warning system as claimed in claim 1, wherein said sensor included in said sensing means is a pressure sensor.

4. The sensing and warning system as claimed in claim 1, wherein said oil container is filled with sealed liquid oil so that enabling said sensor to detect the variation of the oil pressure with a probe attached to its end thereof.

5. The sensing and warning system as claimed in claim 1, wherein said alarm is selected from a group consisting of a buzzer, and an electronic strobe light.

6. The sensing and warning system as claimed in claim 1, wherein said sensor is selected from a group consisting of a diaphragm type, a lever type, and a S type sensor.

7. The sensing and warning system as claimed in claim 1, wherein said connecting member is formed into a block structure able to be fitted in the ladder foot, or sleeved over the ladder foot and then in both cases, screw-bolted to the ladder foot.

* * * * *